United States Patent [19]

Swaney

[11] 4,155,482

[45] * May 22, 1979

[54] INSULATED CRYOGENIC LIQUID CONTAINER

[75] Inventor: William A. Swaney, Toledo, Ohio

[73] Assignee: Owens-Corning Fiberglas Corporation, Toledo, Ohio

[ * ] Notice: The portion of the term of this patent subsequent to Sep. 27, 1994, has been disclaimed.

[21] Appl. No.: 829,554

[22] Filed: Aug. 31, 1977

Related U.S. Application Data

[63] Continuation of Ser. No. 628,279, Nov. 3, 1975, abandoned.

[51] Int. Cl.[2] ..... B65D 87/24; B63B 25/16

[52] U.S. Cl. ..... 220/415; 220/445; 220/464; 220/469; 52/404; 52/573

[58] Field of Search ..... 220/9 LG, 15, 415, 464, 220/469

[56] References Cited

U.S. PATENT DOCUMENTS

| | | | |
|---|---|---|---|
| 3,079,026 | 2/1963 | Dosker | 220/9 LG |
| 3,150,793 | 9/1964 | Messer | 52/615 X |
| 3,158,383 | 11/1964 | Anderson et al. | 220/9 F |
| 3,206,057 | 9/1965 | Prew | 220/15 |
| 3,339,778 | 9/1967 | Herrenschmidt | 220/9 LG |
| 3,339,783 | 9/1967 | Gorman | 220/9 LG |
| 3,367,492 | 2/1968 | Pratt et al. | 220/9 LG |
| 3,403,651 | 10/1968 | Gilles | 220/9 LG X |
| 3,486,286 | 12/1969 | Samaga | 52/573 X |
| 3,525,661 | 8/1970 | Jackson | 220/9 LG X |
| 3,595,728 | 7/1971 | Robson | 220/15 |
| 3,655,086 | 4/1972 | Trenner | 220/9 LG |
| 3,730,375 | 5/1973 | Reed et al. | 220/9 LG |
| 3,785,320 | 1/1974 | Bourgeois et al. | 220/9 LG X |
| 3,800,970 | 4/1974 | Jackson | 220/9 LG |
| 3,811,593 | 5/1974 | Bridges et al. | 220/9 LG |
| 3,814,275 | 6/1974 | Lemons | 220/9 LG |
| 3,855,811 | 12/1974 | Sauerbrunn et al. | 220/9 LG X |
| 3,878,658 | 4/1975 | Davis et al. | 220/9 LG X |
| 3,894,372 | 7/1975 | Roberts et al. | 220/9 LG X |
| 3,896,961 | 7/1975 | Guichem et al. | 220/9 LG |
| 3,948,406 | 4/1976 | Papanicolaou et al. | 220/9 LG X |
| 4,050,608 | 9/1977 | Smith | 220/9 LG |

FOREIGN PATENT DOCUMENTS

| | | | |
|---|---|---|---|
| 565624 | 9/1958 | Belgium | 220/9 LG |
| 932581 | 7/1963 | United Kingdom | 220/9 LG |

*Primary Examiner*—Herbert F. Ross

*Attorney, Agent, or Firm*—Ronald C. Hudgens; Paul J. Rose

[57] ABSTRACT

Composite panels each having a casing and insulating material in the casing are mounted in a covering layer over the inside of a supporting structure by mechanical fastening means. Joint cover members including insulating material and outer facing material are disposed in the spaces between casings of adjacent composite panels. The outer facing material is sealed to front panel portions of the casings to form a primary barrier for cryogenic liquids therewith. An additional secondary barrier may be provided by using composite panels with interior panels in the casings sealed to inner sides thereof and dividing the casings into front and rear compartments, each having insulation therein, and using front and rear joint cover members, the outer facing material of the rear joint cover members being sealed to outer sides of the casings of adjacent composite panels to form a secondary barrier with the interior panels of the composite panels.

77 Claims, 24 Drawing Figures

INSULATED CRYOGENIC LIQUID CONTAINER

This is a continuation, of application Ser. No. 628,279, filed Nov. 3, 1975, now abandoned.

This invention relates generally to containing means for transporting or storing cryogenic liquids such as liquefied natural gas, and more particularly to an insulated membrane tank.

Prior membrane tanks have used thin sheets of stainless steel or invar as a primary barrier or cryogenic membrane. Leaks at weld lines have been a continuing problem with such membrane tanks. Other membrane tanks have used reinforced plastic foam as a barrier. Purging the foam of explosive gas when repairs must be made has been a problem with foam membrane tanks.

An object of the invention is to provide an improved membrane tank for cryogenic liquids such as liquefied natural gas.

Other objects and advantages will become apparent when the following specification is considered along with the accompanying drawings in which.

While the insulated membrane tank of the invention may be installed inside any enclosure for storage or transport of cryogenic liquids, it is particularly useful in cargo ships for transporting liquefied natural gas and will be described with respect to such cargo ships.

Figure 1:
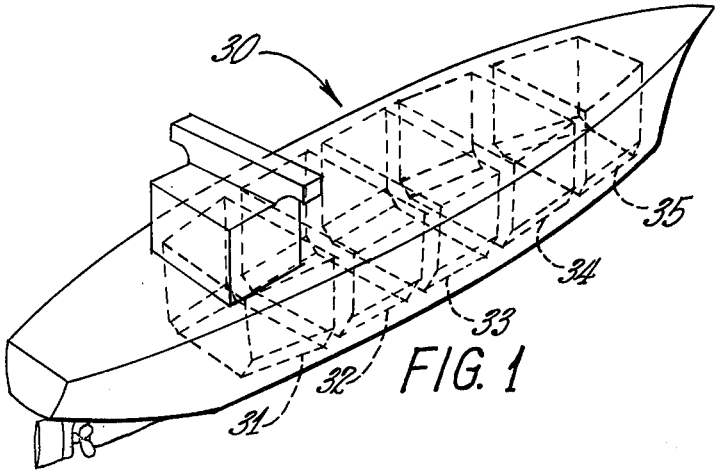
FIG. 1 is a perspective view of a cargo ship having five holds indicated by broken lines and having insulated membrane tanks constructed in accordance with the invention.
Figure 2:
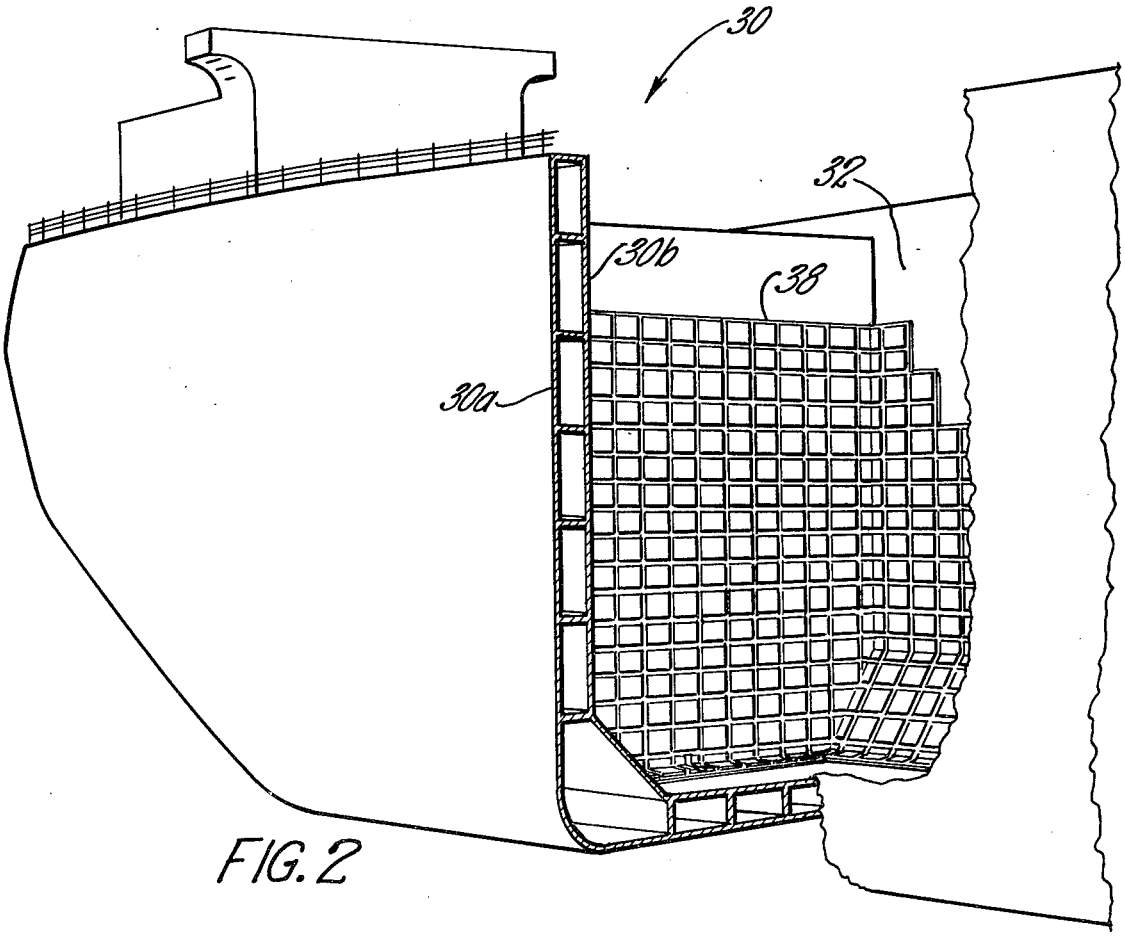
FIG. 2 is an enlarged fragmentary perspective view, with portions broken away, of the cargo ship of FIG. 1, showing one of the holds with a portion of the insulated membrane tank of the invention installed therein.

With reference to the drawings, a cargo ship 30 is shown somewhat schematically in FIG. 1. The ship 30 has five cargo holds 31, 32, 33, 34, and 35 indicated by broken lines. The hold 32 is shown in FIG. 2 with an insulated membrane tank or container 38 constructed in accordance with the invention partially installed therein. The ship 30 includes an outer hull **30*a* and an inner hull 30*b*, the insulated membrane tank of the invention being applied to the inside of the inner hull 30*b* in each of the cargo holds 31–35** and to the transverse bulkheads dividing the cargo space into cargo holds.

Figure 3:
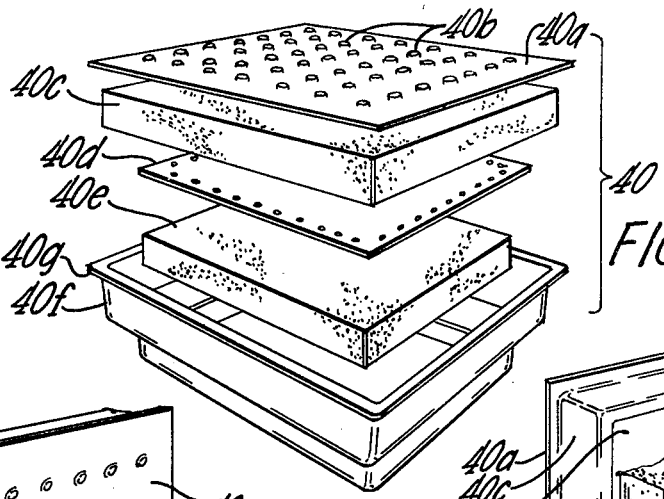
FIG. 3 is an exploded perspective view of one of the side insulation panels of the insulated membrane tank of the invention.
Figure 4:
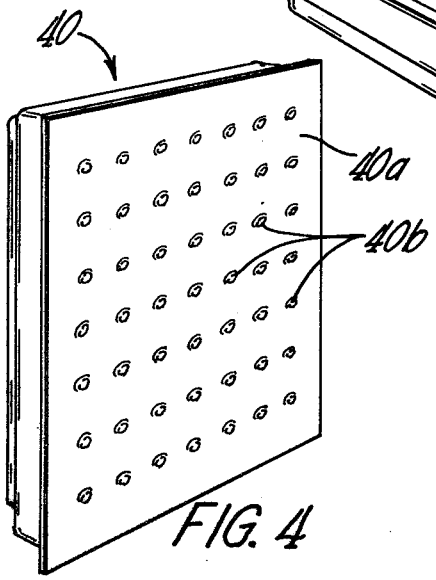
FIG. 4 is a rear perspective view of the insulation panel of FIG. 3.
Figure 5:
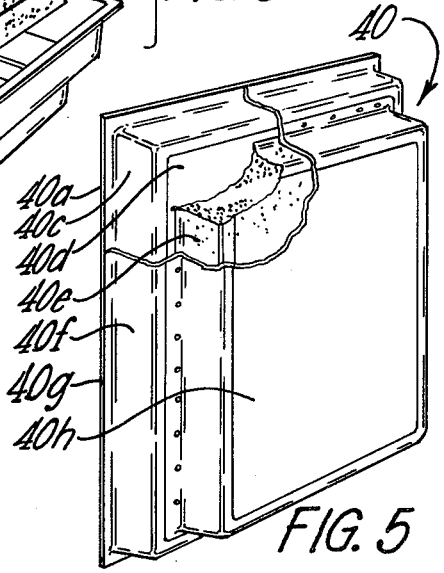
FIG. 5 is a front perspective view of the insulation panel of FIG. 3.

A typical composite panel 40 of the insulated membrane tank is shown in FIGS. 3, 4, and 5. The composite panel 40 includes a generally rectangular backing plate **40*a* of glass fiber reinforced resin provided with a rectangular pattern of rows of spaced protuberances 40*b* of generally hemispherical shape, a generally rectangular rear core 40*c* of rigid polyurethane foam disposed adjacent the backing plate 40*a*, a generally rectangular interior panel 40*d* of glass fiber reinforced resin disposed adjacent the rear core 40*c* and forming part of a cryogenic secondary barrier in an installed insulated membrane tank, a generally rectangular front core 40*e* of rigid polyurethane foam disposed adjacent the interior panel 40*d* and being smaller than the rear core 40*c* and in stepped relationship thereto on all four sides thereof, and a generally rectangular front casing 40*f* of glass fiber reinforced resin. The sides of the casing 40***f* are stepped to match the foam cores 40*c* and 40*e* and each side has an outwardly extending rear flange 40*g* adhesively secured to a respective edge portion of the backing plate 40*a*. The interior panel 40*d* is sealed to offsetting portions of the stepped sides of the casing 40*f* to provide front and rear compartments therein respectively for the front and rear cores 40*e* and 40*c*. A front panel portion 40*h* of the casing 40*f* forms part of the membrane tank or cryogenic primary barrier in an installed insulated membrane tank. The protuberances 40*b* on the backing plate 40*a* enable mounting on an imperfect mounting surface and provide clearance between the mounting surface and the remainder of the backing plate for moisture drainage.

Figure 19:
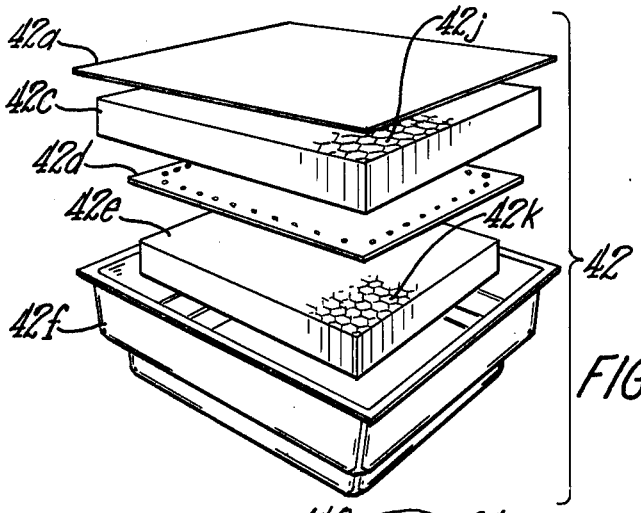
FIG. 19 is an exploded perspective view similar to FIG. 3, but showing one of the bottom insulation panels of the insulated membrane tank of the invention.

FIG. 19 illustrates a composite panel 42 similar to the panel 40 but adapted particularly for the bottom of a membrane tank and including a backing plate 42*a*, foam cores 42*c* and 42*e*, an interior panel 42*d*, and a front casing 42*f*. The backing plate 42*a* has no protuberances such as the protuberances 40*b* of the backing plate 40*a*. The foam cores 42*c* and 42*e* are provided throughout respectively with reinforcing cellular structures 42*j* and 42*k* honeycomb-shaped and only partially shown.

Figure 6:
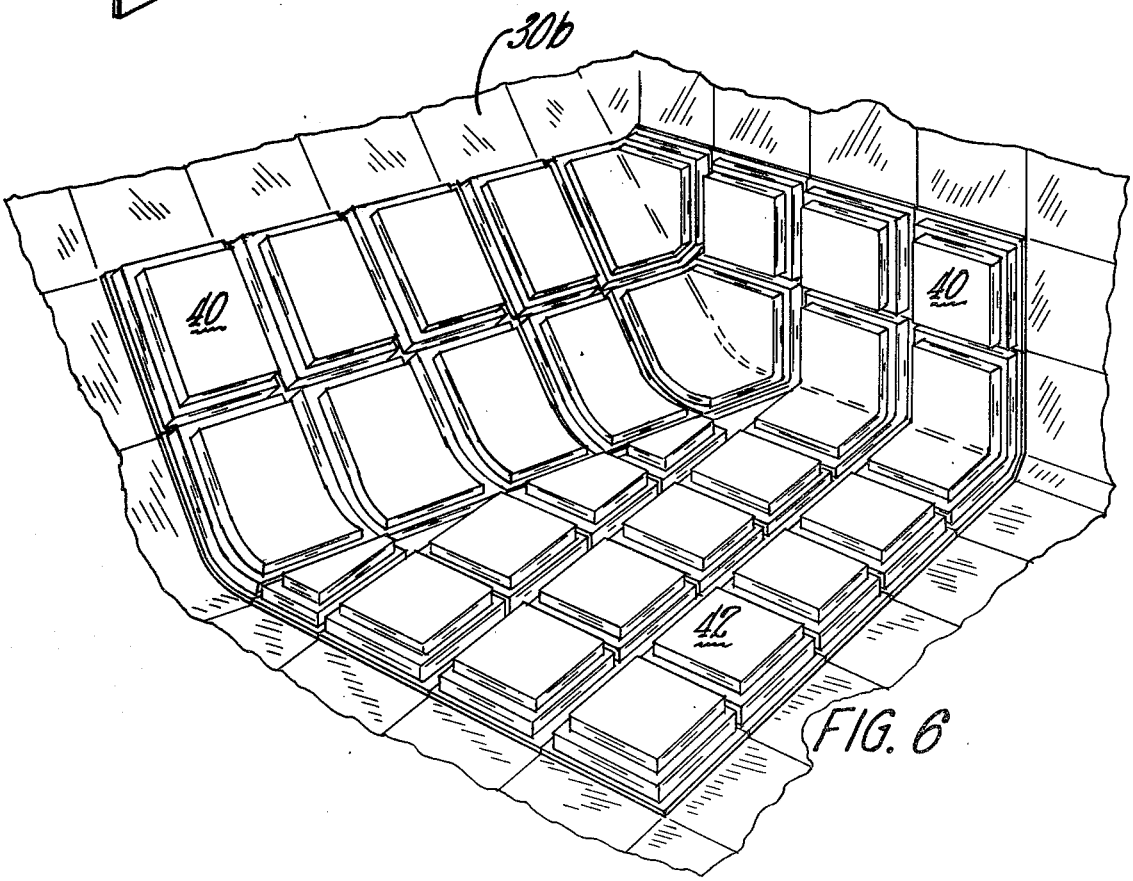
FIG. 6 is a fragmentary perspective view of one of the holds having a trapezoidal bottom showing a portion of the insulated membrane tank of the invention installed therein.
Figure 7:
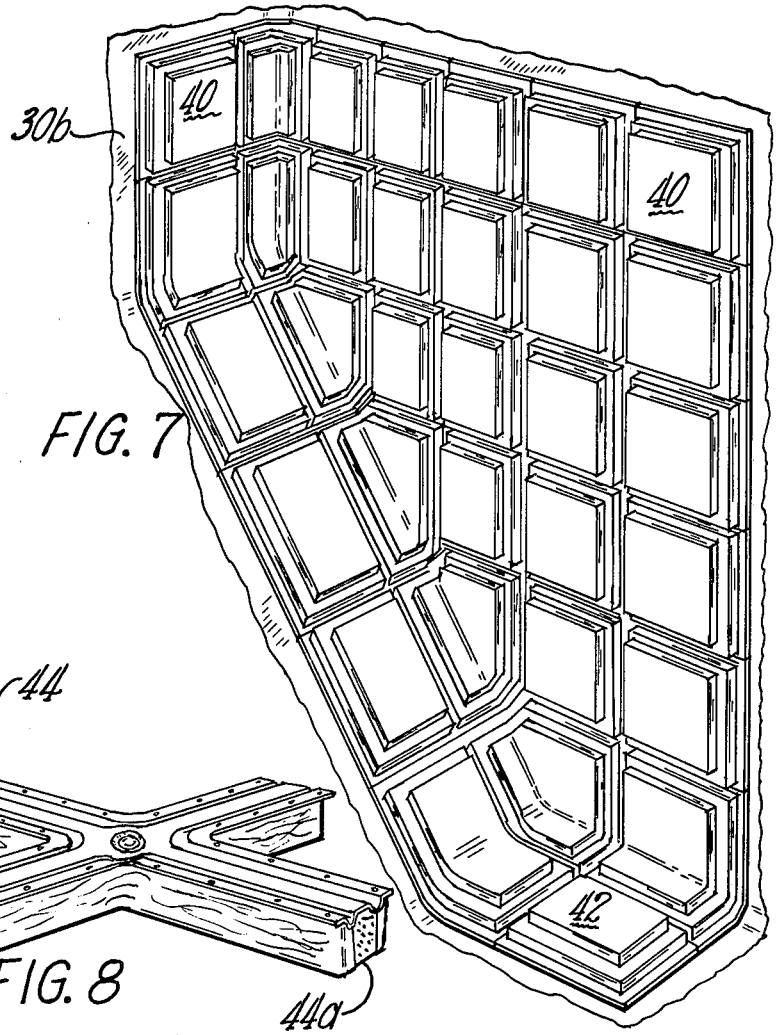
FIG. 7 is a fragmentary perspective view of one of the holds having a rectangular bottom, showing a portion of the insulated membrane tank of the invention installed therein.

FIGS. 6 and 7 show a number of panels, similar to the panels 40 and 42, installed on the inner hull 30*b* of the cargo ship 30 and on respective transverse bulkheads of the cargo ship 30 as part of an insulated membrane tank and illustrate composite panels of various shapes required in corner areas. The composite panels of FIGS. 6 and 7 on the bottom of the inner hull 30*b* are like the panel 42 and those on the side of the inner hull 30*b* and on the vertical transverse bulkhead defining the respective one of the cargo holds 31–35 are like the panel 40. FIG. 6 is representative of the cargo holds 31, 34, and 35 with a trapezoidally shaped bottom wall. FIG. 7 is representative of the cargo holds 32 and 33 (FIG. 1) with a rectangular bottom wall.

Figure 8:
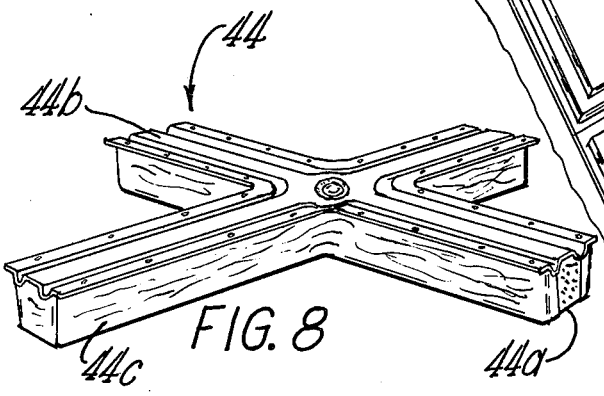
FIG. 8 is a perspective view of a rear joint cover member of the insulated membrane tank of the invention.

FIG. 8 shows a cross-shaped rear joint cover member 44 including a rigid polyurethane foam body 44*a* having an outer or front facing 44*b* of glass fiber reinforced resin bonded thereto and having fibrous glass insulation 44*c* bonded to the sides of the four leg portions thereof and to the outer end faces of two of the leg portions. The facing 44*b* is provided with expansion-contraction grooves and forms part of the cryogenic secondary barrier in an installed insulated membrane tank.

Figure 9:
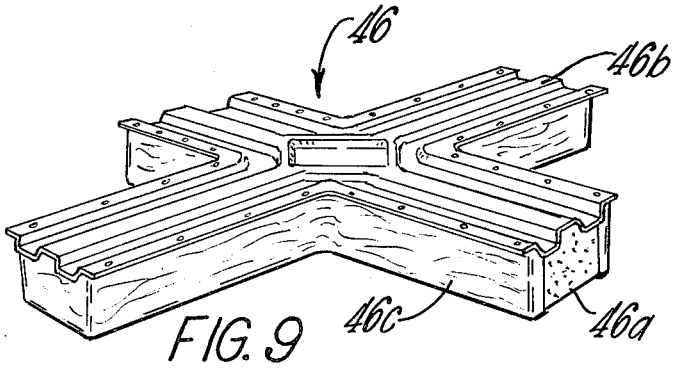
FIG. 9 is a perspective view of a front joint cover member of the insulated membrane tank of the invention.

FIG. 9 shows a cross-shaped front joint cover member 46 similar to the rear joint cover member 44 but having wider leg portions. The member 46 includes a rigid polyurethane foam body 46*a*, an outer or front facing 46*b* of glass fiber reinforced resin, and fibrous glass insulation 46*c*. The facing 46*b* is provided with expansion-contraction grooves and forms part of the membrane tank or cryogenic primary barrier in an installed insulated membrane tank. In high pressure areas such as the bottom and lower portions of the sides of a membrane tank, the foam bodies of joint cover members 44 and 46 are reinforced with cellular structure such as honeycomb-shaped structures 42*j* and 42*k* of the composite panel 42 of FIG. 19.

The invention has been shown in a preferred embodiment, particularly with respect to the joint cover members of FIGS. 8 and 9. However, the specific form of the joint cover members shown in this application is the invention of Roy E. Smith and is claimed in application Ser. No. 628,297, filed on Nov. 3, 1975, and now U.S. Pat. No. 4,050,608, issued on Sept. 27, 1977.

Figure 10:
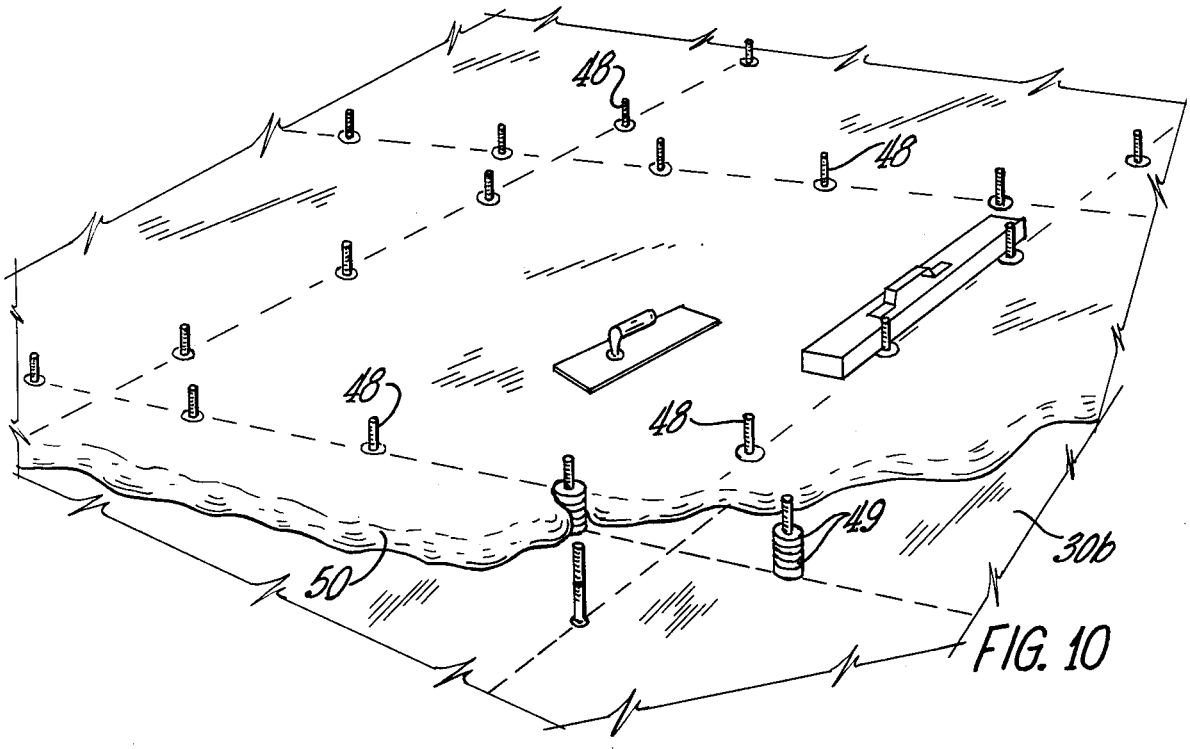
FIG. 10 is a fragmentary perspective view of the bottom surface of one of the holds showing a portion of a layer of levelling compound applied before installation of bottom panels of the insulated membrane tank of the invention.
Figure 18:
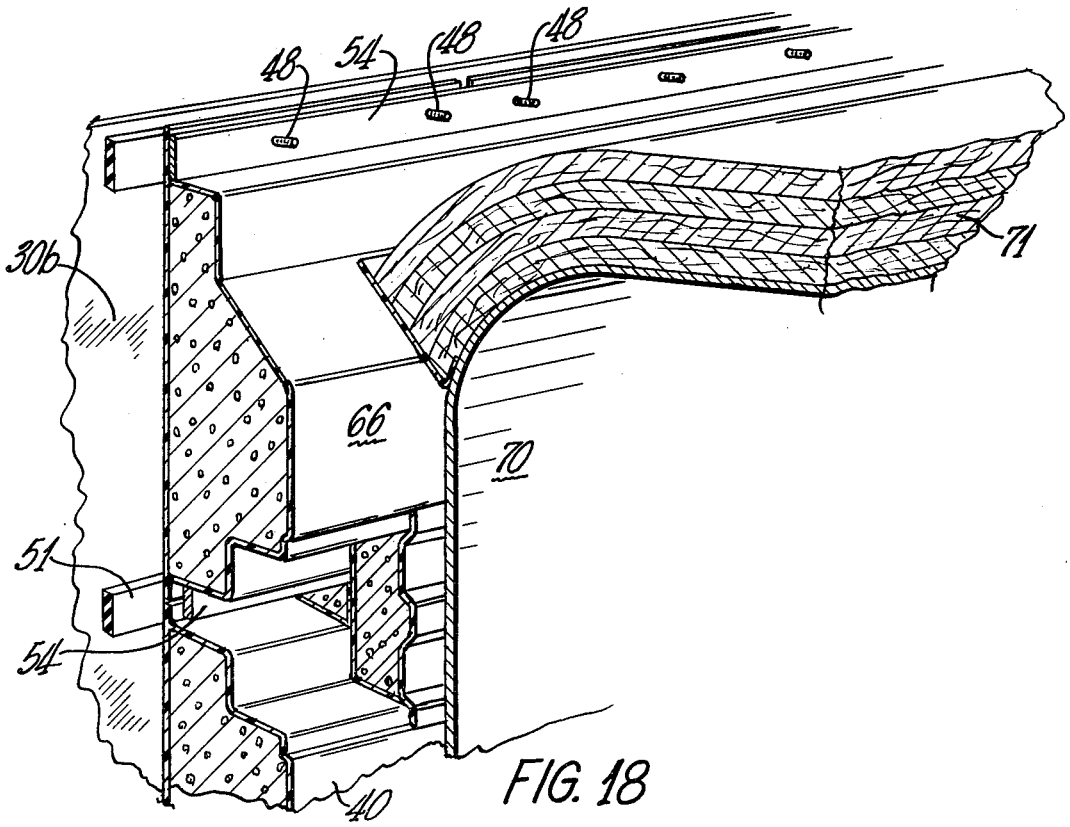
FIG. 18 is a fragmentary perspective view, partially in section, of an upper side portion of one of the holds showing a modification wherein a free standing metal tank is provided and the insulated membrane tank of the invention acts merely as insulating and support means.

FIG. 10 shows the inside bottom surface of the inner hull 30*b* with rows of studs 48 welded thereto, spacers 49 on the studs 48 to define a desired level, and levelling compound 50 being applied to the desired level before panels such as the panel 42 are installed. The levelling compound 50 is used only when a free standing metal tank is provided such as shown in the modification of FIG. 18.

Figure 11:
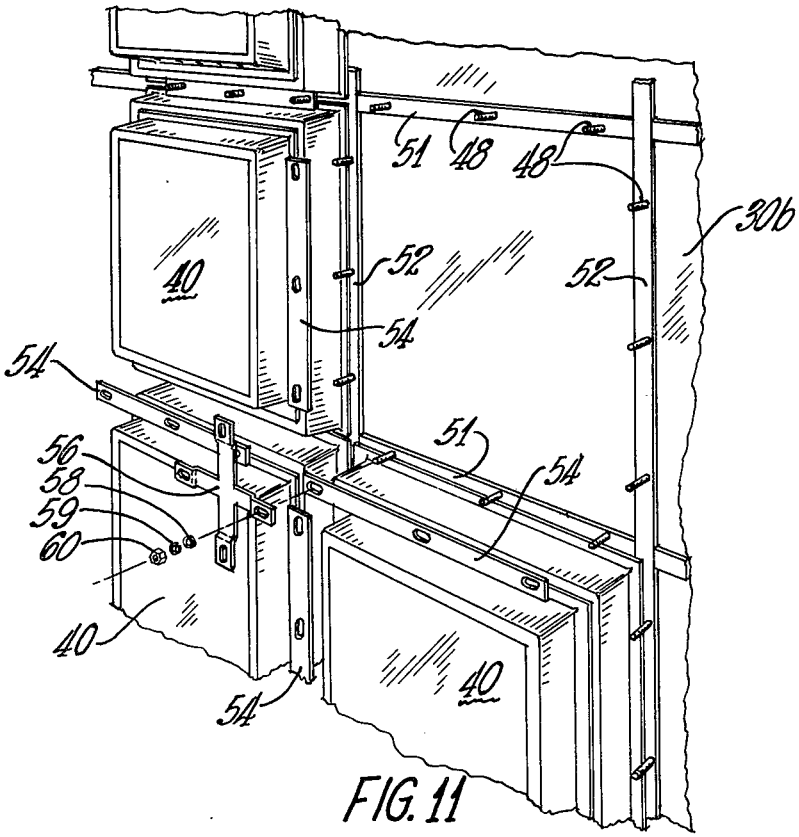
FIG. 11 is a partially exploded fragmentary perspective view showing installation of side panels of the insulated membrane tank of the invention.

FIG. 11 shows a vertical side wall portion of the inner hull 30*b* with rows of the studs 48 welded thereto, elastomeric sealing strips 51 and 52 in place over the rows of studs 48, panels 40 in place over the sealing strips, straight fastening strips 54 in position for mounting on the studs to clamp the panels 40 in place, and a cross-shaped fastener 56 in position for mounting on the studs. In an installed insulated membrane tank, each stud 48 is provided with a flat washer 58, a lock washer 59, and a nut 60. The sealing strips 51 are vertically grooved on their rear sides for drainage of moisture. The sealing strips prevent passage of liquid or gaseous fluids past the rear flanges 40*g* of adjacent panels 40.

The inner hull 30*b* and the two transverse bulkheads defining each of the cargo holds 31–35 provide a supporting enclosure having a plurality of generally planar inner surfaces. The studs 48 are secured to the planar surfaces at the bottom and sides of the inner hull 30*b* and at the transverse bulkheads in regularly spaced, parallel rows extending in each of two cross-directions to define a plurality of generally rectangular mounting areas respectively for the composite panels such as the panels 40 and 42.

Figure 12:
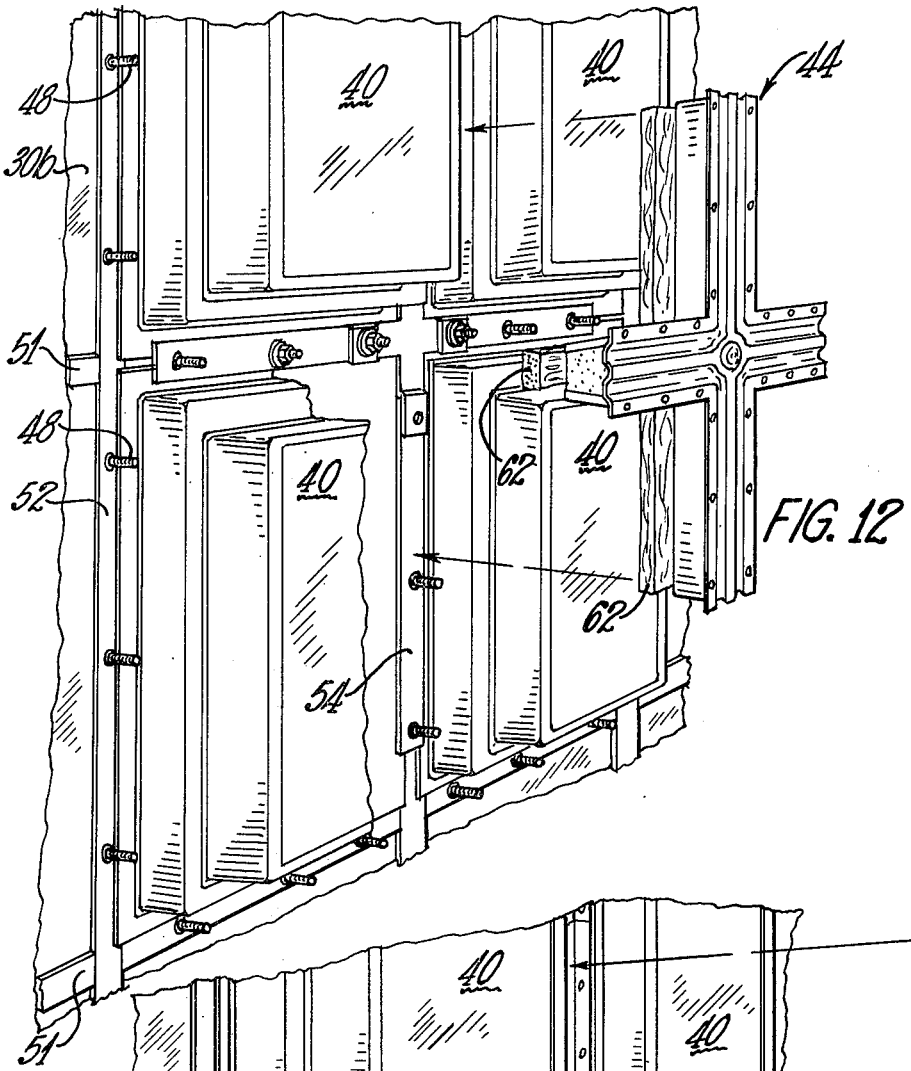
FIG. 12 is a partially exploded fragmentary perspective view showing installation of a rear joint cover member of the insulated membrane tank of the invention.

FIG. 12 shows a rear joint cover member 44 in position for mounting over strips 62 of fibrous glass insulation stuffed between the panels 40 and against the fastening strips 54, cross-shaped fasteners 56, studs 48, etc.

Figure 13:
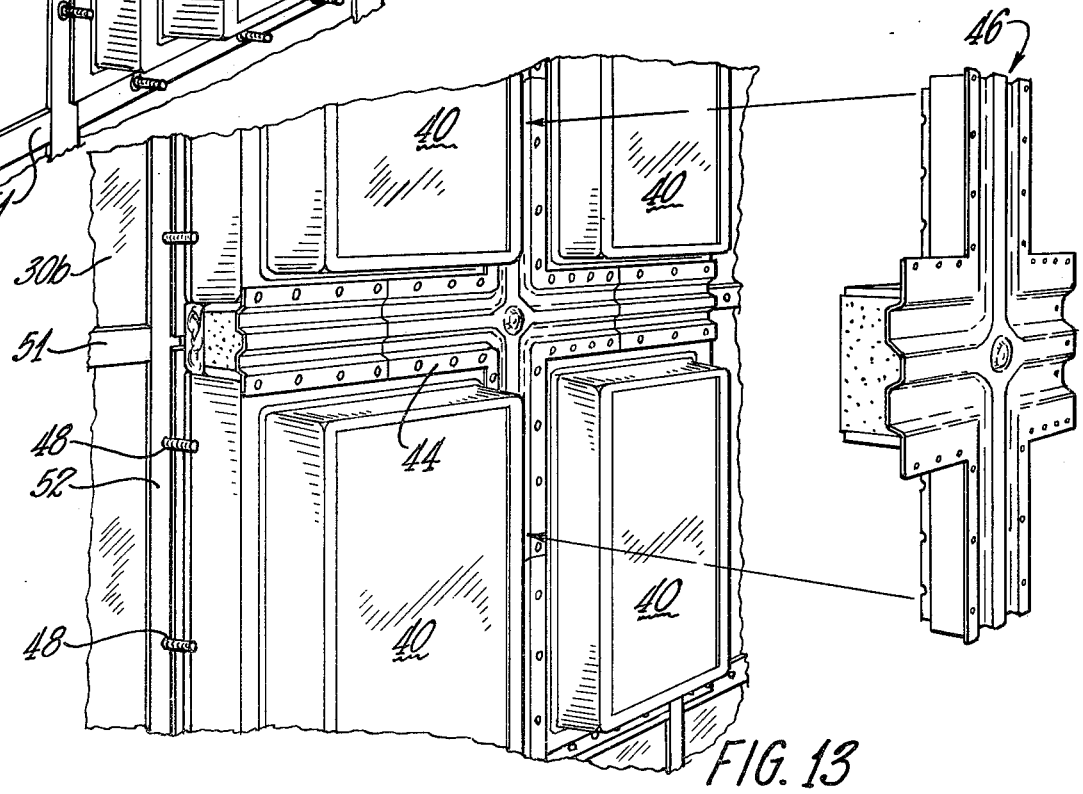
FIG. 13 is a partially exploded fragmentary perspective view showing installation of a front joint cover member of the insulated membrane tank of the invention.

FIG. 13 shows a front joint cover member 46 in position for mounting over a rear joint cover member 44.

Figure 14:
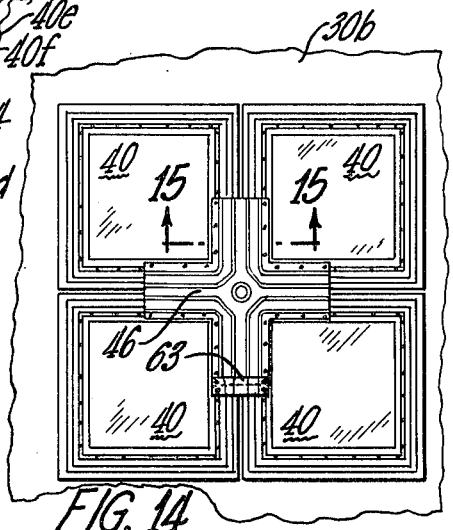
FIG. 14 is a fragmentary elevational view of a side of one of the holds showing four side panels and a front joint cover member of the insulated membrane tank of the invention in place thereon.

FIG. 14 shows a front joint cover member 46 in mounted position over a rear joint cover member 44 (not shown), each leg portion of each of the members 44 and 46 being disposed between a pair of adjacent panels 40. A joint cover strip 63 of glass fiber reinforced resin is shown in an illustrative position. Each strip 63 normally covers the joint between the facings 46*b* (FIG. 9) of adjacent leg portions of an adjacent pair of front joint cover members 46.

Figure 15:
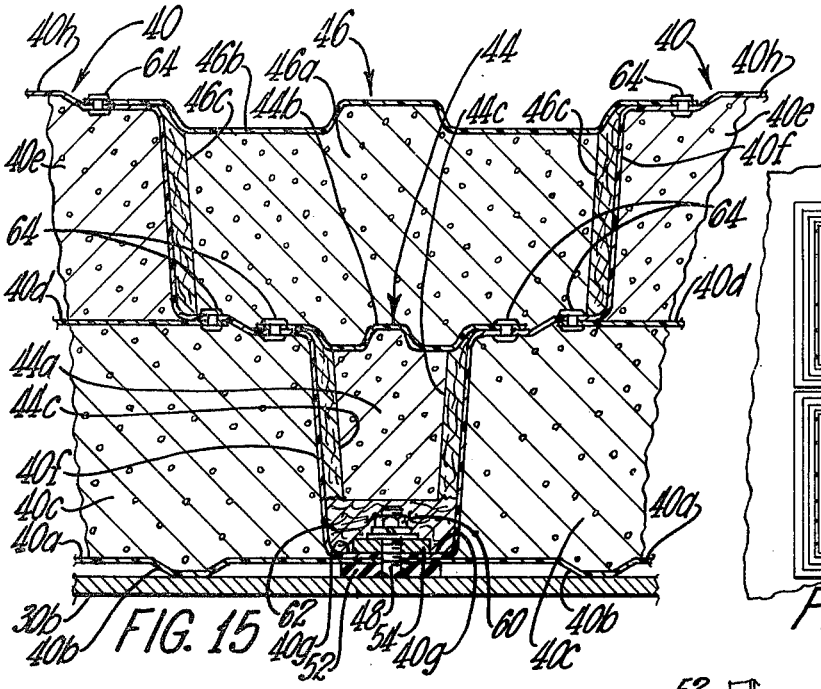
FIG. 15 is a fragmentary sectional view taken generally along the line 15—15 of FIG. 14.

FIG. 15 shows a fragmentary section through a pair of adjacent panels 40 and leg portions of a rear joint cover member 44 and a front joint cover member 46 disposed between the panels 40. The front panel portions 40*h* and the facing 46*b* form part of the membrane tank or cryogenic primary barrier. The foam cores 40*e*, the foam body 46*a*, and the fibrous glass insulation 46*c* form the insulation for the primary barrier 40*h*–46*b*. The interior panels 40*d*, the facing 44*b*, and the offsetting portions of the stepped sides of the casings 40*f* form part of the cryogenic secondary barrier. The foam cores 40*c*, the foam body 44*a*, and the fibrous glass insulation 44*c* and 62 form the insulation for the secondary barrier 40*d*–44*b*. The fastening strip 54 secured on the stud 48 by the nut 60 secures the flanges 40*g* of the casing 40*f* and edge portions of the backing plates 40*a* against the sealing strip 52 and the inner hull 30*b*. The interior panels 40*d* and the facing 44*b* are adhesively sealed to the offsetting portions of the stepped sides of the casings 40*f* and the facing 46*b* is adhesively sealed to the front panel portions 40*h*. Pop rivets 64 are provided in the embodiment of FIG. 15 to secure the parts in position until the adhesive (not shown) fully sets.

Figure 16:
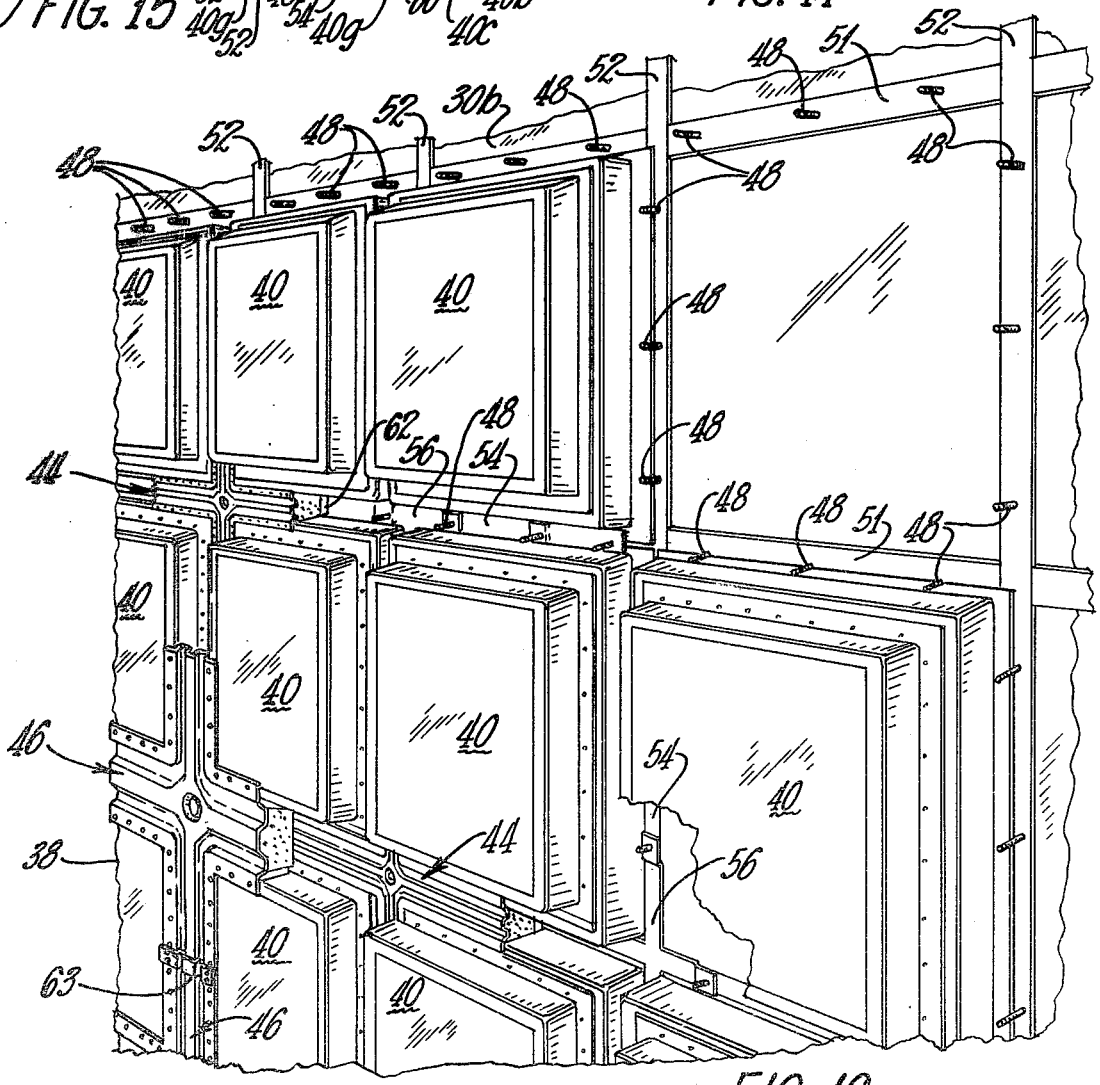
FIG. 16 is a fragmentary perspective view of a side of one of the holds showing portions of the insulated membrane tank of the invention installed thereon.

FIG. 16 is a fragmentary perspective view showing various parts of a partially completed installation of the insulated membrane tank 38 of the invention on the inner hull 30*b*.

Figure 17:
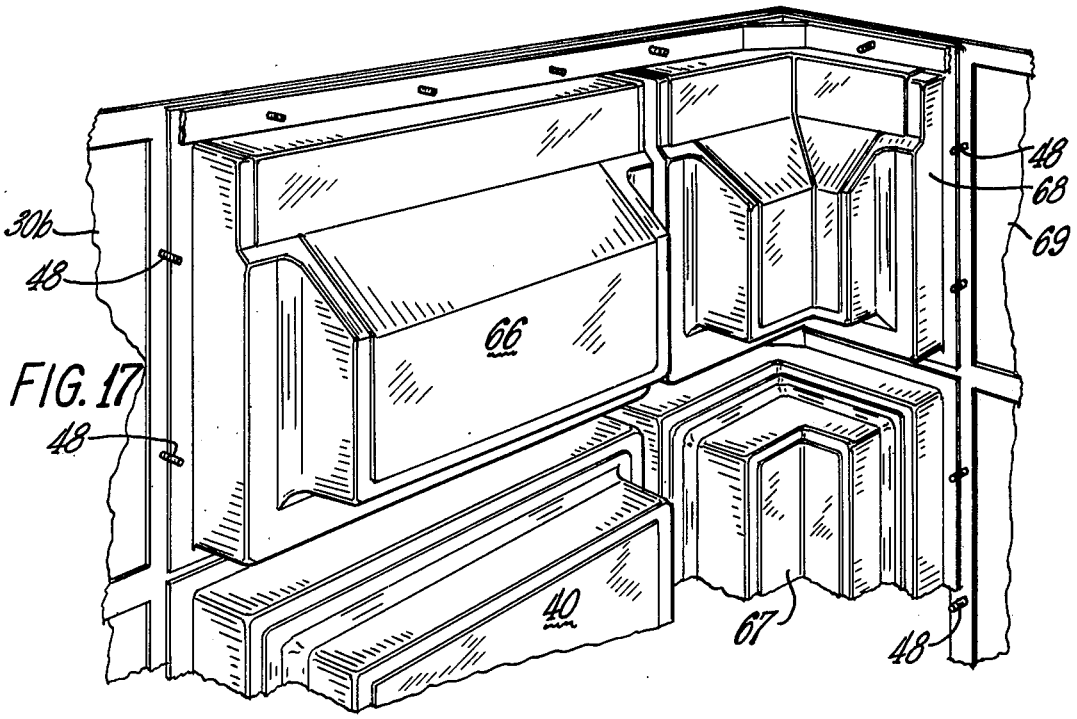
FIG. 17 is a fragmentary perspective view of an upper corner portion of one of the holds showing portions of the insulated membrane tank of the invention installed thereon.

FIG. 17 is a fragmentary perspective view of an upper corner portion of one of the cargo holds 31–35 showing the different shape of upper and corner composite panels similar to the panel 40, such as an upper panel 66 on the inner hull 30*b*, a corner panel 67, and an upper corner panel 68, the panels 67 and 68 being partially on the inner hull 30*b* and partially on a transverse bulkhead 69.

FIG. 18 shows a modification wherein a free-standing metal tank 70 independent of the inner hull 30*b* is provided, a top wall of the tank being insulated with fibrous glass insulation 71. In this embodiment, the tank 70 is the primary barrier, the front panel portions 40*h* and facings 46*b* form a secondary barrier, and the panels 40*d* and facings 44*b* form a tertiary barrier.

Figure 20:
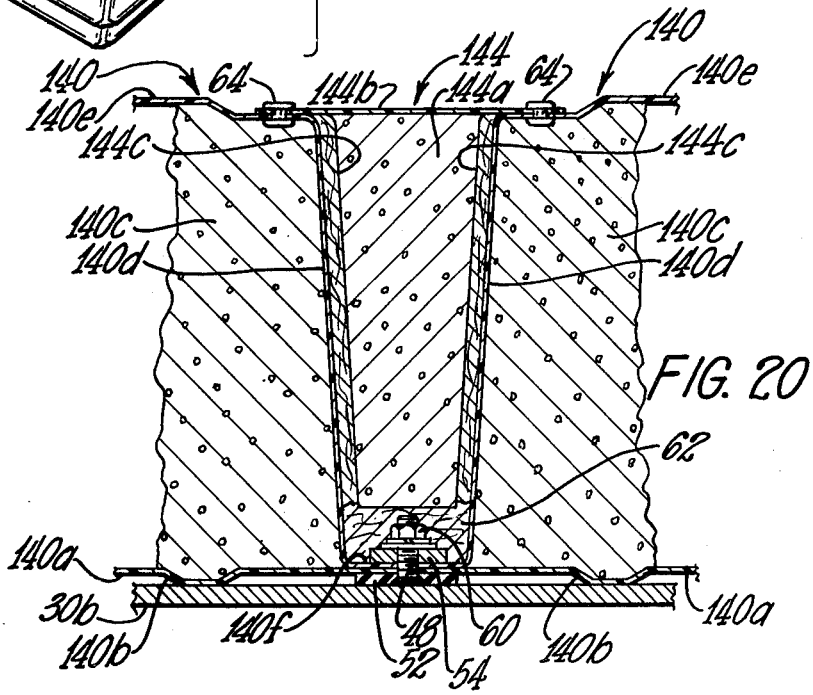
FIG. 20 is a fragmentary sectional view similar to FIG. 15, but illustrating a modification of the insulated membrane tank of FIGS. 1–19.

FIG. 20 is a view similar to FIG. 15, but showing a modification wherein the secondary barrier provided by the panels 40*d* and facings 44*b* is eliminated. Two composite panels 140 are shown along with a single joint cover member 144. Each panel 140 includes a backing plate 140*a* formed of glass fiber reinforced resin and provided with protuberances 140*b*, a core 140*c* of rigid polyurethane foam, and a front casing 140*d* of glass fiber reinforced resin. The joint cover member 144 is cross-shaped similarly to the members 44 and 46 of FIGS. 8 and 9 and includes a polyurethane foam body 144*a* bonded to an outer or front facing 144*b* of glass fiber reinforced resin and having fibrous glass insulation 144*c* bonded to the sides of the four leg portions thereof and to the outer end faces of two of the leg portions. Front panel portions 140*e* of the casings 140*d* and the facing 144*b* form part of a cryogenic barrier or membrane tank in an installed insulated membrane tank. The fastening strip 54 secured on the stud 48 by the nut 60 secures flanges 140*f* of the casings 140*d* and edge portions of the backing plates 140*a* against the sealing strip 52 and the inner hull 30*b*.

Figure 21:
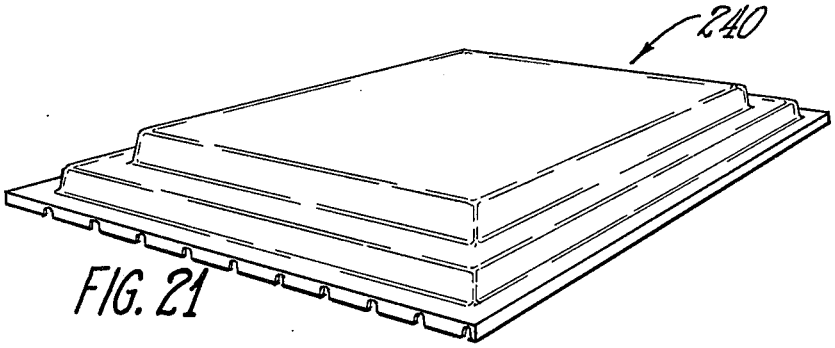
FIG. 21 is a front perspective view of an insulation panel of another modified form of insulated membrane tank.
Figure 22:
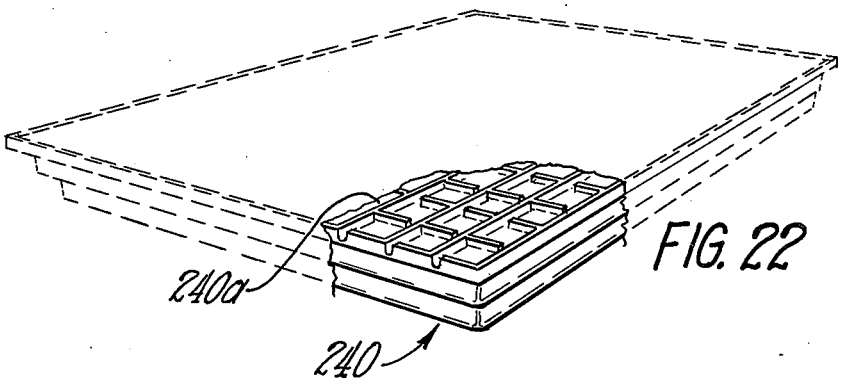
FIG. 22 is a fragmentary rear perspective view of the insulation panel of FIG. 21.

FIGS. 21–24 illustrate another modification of the insulated membrane tank of the invention. FIGS. 21 and 22 show a composite panel 240 similar to the panel 40 of FIGS. 3–5, but having a labyrinth backing panel 240*a* instead of the backing panel 40*a* with the rows of spherical protuberances 40*b*. The labyrinth backing panel 240*a* is partially shown most clearly in FIG. 22. In an installed membrane tank, labyrinth channels on the rear of the backing panels 240*a* extend vertically for moisture drainage.

The specific form of the backing panel 240*a* is the invention of Roy E. Smith and is claimed in application Ser. No. 774,558, filed Mar. 4, 1977, which is a division of application Ser. No. 628,297, filed on Nov. 3, 1975, and now U.S. Pat. No. 4,050,608, issued on Sept. 27, 1977.

Figure 23:
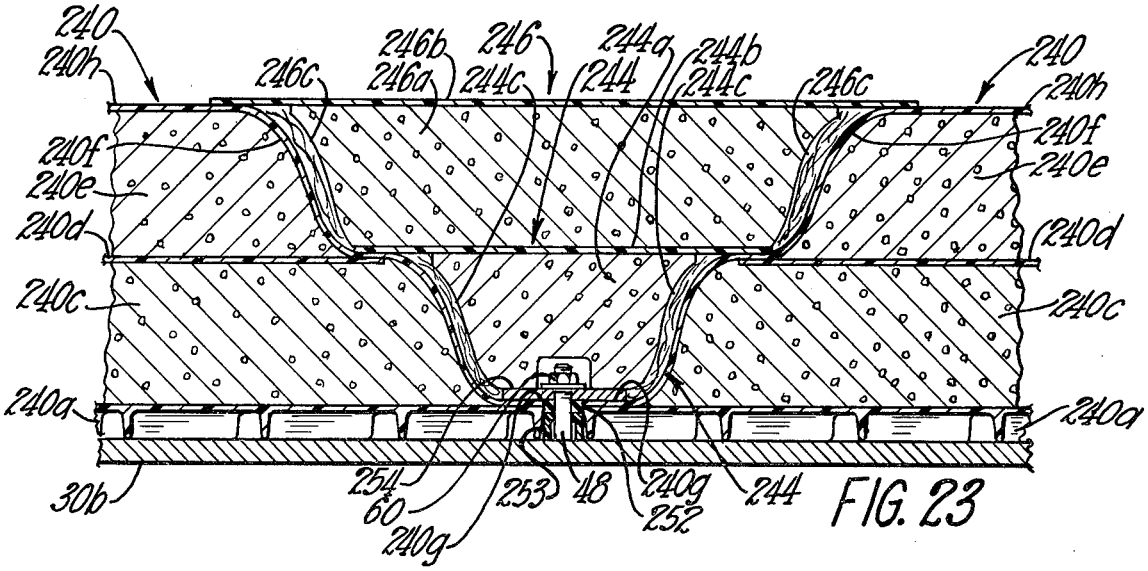
FIG. 23 is a fragmentary sectional view similar to FIG. 15, illustrating the modified insulated membrane tank embodying panels such as that of FIGS. 21 and 22.

FIG. 23 is a view similar to FIG. 15 but illustrating a portion of an insulated membrane tank using panels such as the panel 240 of FIGS. 21 an 22. Each panel 240 of the two partially shown in section in FIG. 23 includes a labyrinth backing panel 240*a* of glass fiber reinforced resin, foam cores 240*c* and 240*e*, an interior panel 240*d* of glass fiber reinforced resin between the cores, and a front casing 240*f* of glass fiber reinforced resin having flanges 240*g* clamped against the inner hull 30*b* and having front panel portions 240*h*. A rear joint cover member 244 includes a cross-shaped foam body 244*a*, an outer or front facing 244*b* of glass fiber reinforced resin, and fibrous glass insulation 244*c* on the sides of the four leg portions of the foam body and on the ends of two of the leg portions, similarly to the rear joint cover member 44 of FIG. 8. A front joint cover member 246 is similarly constructed with a foam body 246*a*, facing 246*b*, and fibrous glass insulation 246*c*. The joint cover members 244 and 246 respectively have wider leg portions than the joint cover members 44 and 46, and the casings 240*f* have larger radii of curvature in the stepped sidewall portions than the casings 40*f*. The facings 244*b* and 246*b* are flat, rather than being provided with expansion-contraction grooves as are the facings 44*b* and 46*b*. A faster setting adhesive (not shown) enables the panels 240*d* and facings 244*b* and 246*b* to be secured to the casings 240*f* without any rivets 64. Also, the fibrous glass insulation 62 at the inner surface of the inner joint cover member 44 is eliminated in the embodiment of FIG. 23, the rear joint cover member body 244*a* being recessed to receive studs 48 and nuts 60. A backing strip 253 preferably formed of glass fiber reinforced plastic is provided for an elastomeric sealing strip 252. A fastening strip 254 is generally T-shaped in cross section and secures the flanges 240*g* and edge portions of the backing plates 240*a* against the inner hull 30*b* while compressing the sealing strip 252 against the backing strip 253 and also against the edges of the flanges 240*g*. The front portions 240*h* and the facing 246*b* form part of a membrane tank or cryogenic primary barrier for cryogenic liquids such as liquefied natural gas. The panels 240*d* and the facing 244*b* form part of a cryogenic secondary barrier.

Figure 24:
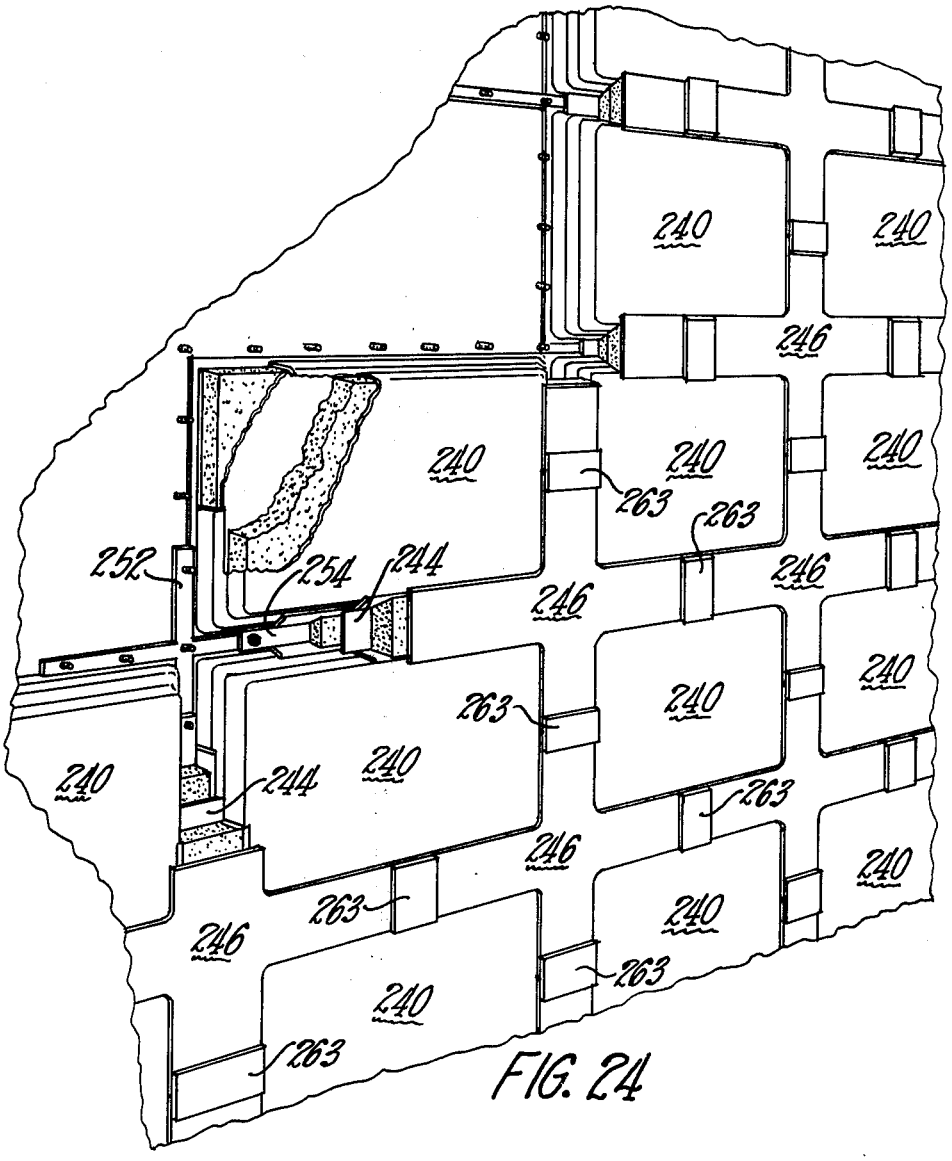
FIG. 24 is a fragmentary perspective view similar to FIG. 16, but illustrating the modified form of insulated membrane tank of FIGS. 21–23.

FIG. 24 is a fragmentary perspective view further illustrating the insulated membrane tank of FIG. 23. The composite panels 240 of FIG. 24 are elongated horizontally. Joint cover strips 263 of glass fiber reinforced resin are provided over the facings 246*b* at the joints between adjacent leg portions of adjacent outer joint cover members 246.

Various modifications may be made in the structure shown and described without departing from the spirit and scope of the invention as set forth in the appended claims. Alternate materials may be used, depending on requirements. The insulating cores 40*c* and 40*e* may be formed of other synthetic foams such as acrylic foam, polyvinylchloride foam, or polystyrene foam, or of balsa wood, plywood, foam glass, perlite, cork, rock wool, fibrous glass, or various combinations of these and other materials. The front panel portions 40*h* may be molded or otherwise provided with additional support to permit use of insulation of a non-load-bearing type. The cellular reinforcing structures 42*j* and 42*k* may be other than honeycomb-shaped. The backing plates 40*a*, interior panels 40*d*, front casings 40*f*, outer facings 44*b* and 46*b*, joint cover strips 63 and 263, and backing strips 253 may be formed of invar, stainless steel, or aluminum with or without plastic coating, or of unreinforced resin, or of resin reinforced with other suitable natural or synthetic fibers such as cotton, jute, polyamiddes, acrylics, asbestos, boron, carbon, stainless steel, or other metal fibers.

The panels 40, 42, 140, and 240 and joint cover members 44, 46, 144, 244, and 246 may be designed for mounting on cylindrical, spherical, or other curved surfaces by appropriate shaping, and need not necessarily be rectangular.

For ability to withstand thermal shock, it has been found particularly advantageous to form the casings such as casings 40*f*, 42*f*, 140*d*, and 240*f*, the interior panels such as panels 40*d*, 42*d*, and 240*d*, and the outer facings such as facings 44*b*, 46*b*, 144*b*, 244*b*, and 246*b* of a glass fiber reinforced bisphenol-A/epichlorohydrin epoxy resin cured with an amine, a Lewis acid, or an acid anhydride such as NADIC methyl anhydride, hexahydrophthalic anhydride, or polyazelaic polyanhydride. A small amount of 2-ethyl-4-methyl-imidazole may be included as an accelerator, and a flexibilizer such as tetraethylene glycol may be added.

Glass fiber reinforced bisphenol-A/epichlorohydrin epoxy resins with a weight per epoxide of 175 to 280 and with polyazelaic polyanhydride as a curing agent in the amount of 50 to 100 parts by weight per 100 parts of epoxy resin have good thermal shock resistance. A second curing agent or accelerator of 2-ethyl-4-methyl-imidazole in the amount of up to 2 parts by weight per 100 parts of epoxy resin may be included. For some applications, a flexibilizer of tetraethylene glycol in the amount of up to 20 parts by weight per 100 parts of epoxy resin may be beneficial.

Glass fiber reinforcement may be in the form of chopped strand, continuous strand non-woven mat, or woven roving, and may comprise up to 80 percent of the total weight, although it is normally 25 to 70 percent of the total weight of the casing, interior panel, or outer facing.

A bisphenol-A/epichlorohydrin epoxy resin with a weight per epoxide of 185 to 192 and with curing agents of polyazelaic polyanhydride in the amount of about 90 parts by weight per 100 parts of epoxy resin and 2-ethyl-4-methyl-imidazole in the amount of about 1 part by weight per 100 parts of epoxy resin has been found to be particularly crack resistant under thermal shock, with non-woven continuous strand glass fiber mat reinforcement in the amount of about 60 percent of the total weight of the casing, interior panel, or outer facing.

I claim:

1. An insulated cryogenic liquid container comprising a supporting structure, an enclosure mounted within the supporting structure and having a wall portion partially formed by a preformed and unitarily mounted composite insulating panel including a generally rectangular casing having a front panel portion and a rear mounting flange, an interior panel sealed to and dividing the casing into front and rear compartments, and insulating material in each of the compartments, and means clamping the mounting flange to the supporting structure to mechanically removably secure both a portion of a primary barrier and a portion of a secondary barrier in position, the front panel portion of the casing forming the portion of the primary barrier and the interior panel forming the portion of the secondary barrier, the primary barrier directly contacting and confining cyrogenic liquid when the container is in use and the secondary barrier confining any cryogenic fluid which escapes through any unforeseen defects in the primary barrier.

2. An insulated container as claimed in claim 1 wherein the casing of the composite insulating panel comprises glass fiber reinforced resin.

3. An insulated container as claimed in claim 1 wherein the interior panel of the composite insulating panel comprises glass fiber reinforced resin.

4. An insulated container as claimed in claim 1 wherein the insulating material in the rear compartment of the casing of the composite insulating panel comprises foamed resin.

5. An insulated container as claimed in claim 1 wherein the insulating material in the rear compartment of the casing of the composite insulating panel comprises polyurethane foam.

6. An insulated container as claimed in claim 1 wherein the insulating material in the rear compartment of the casing of the composite insulating panel comprises foamed resin reinforced with cellular structure.

7. An insulated container as claimed in claim 1 wherein the insulating material in the rear compartment of the casing of the composite insulating panel comprises foamed resin reinforced with honeycomb-shaped structure.

8. An insulated container as claimed in claim 1 wherein the insulating material in the front compartment of the casing of the composite insulating panel comprises foamed resin.

9. An insulated container as claimed in claim 1 wherein the insulating material in the front compartment of the casing of the composite insulating panel comprises polyurethane foam.

10. An insulated container as claimed in claim 1 wherein the insulating material in the front compartment of the casing of the composite insulating panel comprises foamed resin reinforced with cellular structure.

11. An insulated container as claimed in claim 1 wherein the insulating material in the front compartment of the casing of the composite insulating panel comprises foamed resin reinforced with honeycomb-shaped structure.

12. An insulated cryogenic liquid container comprising a supporting enclosure having an inner surface, a plurality of composite insulating panels each including a casing having a front panel portion, an interior panel sealed to and dividing the casing into front and rear compartments, and insulating material in each of the compartments, mounting means securing the composite panels in a covering layer over the inner surface with space between the casings of each pair of adjacent composite panels, rear joint cover means including insulating material disposed in the space between the casings of each pair of adjacent composite panels substantially in alignment with the rear compartments thereof and outer facing material covering the insulating material, bridging the space between the casings, and being sealed thereto on the sides thereof to form a secondary barrier with the interior panels of the composite panels, and front joint cover means including insulating material disposed in the space between the casings of each pair of adjacent composite panels substantially in alignment with the front compartments thereof and outer facing material covering the insulating material, bridging the space between the casings, and being sealed thereto to form a primary barrier with the front panel portions thereof, the primary barrier directly contacting and confining cryogenic liquid when the container is in use and the secondary barrier confining any cryogenic fluid which escapes through any unforeseen defects in the primary barrier.

13. An insulated container as claimed in claim 12 wherein the insulating material of the rear joint cover means comprises foamed resin.

14. An insulated container as claimed in claim 12 wherein the insulating material of the rear joint cover means comprises foamed resin and fibrous glass.

15. An insulated container as claimed in claim 12 wherein the insulating material of the rear joint cover means comprises polyurethane foam.

16. An insulated container as claimed in claim 12 wherein the outer facing material of the rear joint cover means comprises glass fiber reinforced resin.

17. An insulated container as claimed in claim 12 wherein the insulating material of the front joint cover means comprises foamed resin.

18. An insulated container as claimed in claim 12 wherein the insulating material of the front joint cover means comprises foamed resin and fibrous glass.

19. An insulated container as claimed in claim 12 wherein the insulating material of the front joint cover means comprises polyurethane foam.

20. An insulated container as claimed in claim 12 wherein the outer facing material of the front joint cover means comprises glass fiber reinforced resin.

21. An insulated container as claimed in claim 12 wherein the casings of the composite panels comprise glass fiber reinforced resin.

22. An insulated container as claimed in claim 12 wherein the insulating material in the rear compartments of the composite panels comprises foamed resin.

23. An insulated container as claimed in claim 12 wherein the insulating material in the rear compartments of the composite panels comprises polyurethane foam.

24. An insulated container as claimed in claim 12 wherein the insulating material in the rear compartments of some of the composite panels comprises foamed resin reinforced with cellular structure.

25. An insulated container as claimed in claim 12 wherein the insulating material in the rear compartments of some of the composite panels comprises foamed resin reinforced with honeycomb-shaped structure.

26. An insulated container as claimed in claim 12 wherein the insulating material in the front compartments of the composite panels comprises foamed resin.

27. An insulated container as claimed in claim 12 wherein the insulating material in the front compartments of the composite panels comprises polyurethane foam.

28. An insulated container as claimed in claim 12 wherein the insulating material in the front compartments of some of the composite panels comprises foamed resin reinforced with cellular structure.

29. An insulated container as claimed in claim 12 wherein the insulating material in the front compartments of some of the composite panels comprises foamed resin reinforced with honeycomb-shaped structure.

30. An insulated cryogenic liquid container as claimed in claim 12 wherein the casing of each composite insulating panel includes a rear backing plate having a plurality of projecting portions engaging the inner surface and providing clearance between the inner surface and the remainder of the backing plate for moisture drainage.

31. An insulated cryogenic liquid container comprising a supporting enclosure having an inner surface, a plurality of studs secured to the inner surface and defining a plurality of mounting areas thereon, a plurality of composite insulating panels mounted on the inner surface respectively within the mounting areas, each composite insulating panel including a casing having a front panel portion, and interior panel sealed to and dividing the casing into front and rear compartments, and insulating material in each of the compartments, the casing having a laterally outwardly extending rear peripheral mounting flange, mechanical fastening means operatively associated with the studs and with the rear flanges of the casings and securing the composite panels in mounted position on the inner surface with space between the casings of each pair of adjacent composite panels, rear joint cover means including insulating material disposed in the space between the casings of each pair of adjacent composite panels substantially in alignment with the rear compartments thereof and outer facing material covering the insulating material, bridging the space between the casings, and being sealed thereto on the sides thereof to form a secondary barrier with the interior panels of the composite panels, and front joint cover means includng insulating material disposed in the space between the casings of each pair of adjacent composite panels substantially in alignment with the front compartments thereof and outer facing material covering the insulating material, bridging the space between the casings, and being sealed thereto to form a primary barrier with the front panel portions thereof, the primary barrier directly contacting and confining cryogenic liquid when the container is in use and the secondary barrier confining any cryogenic fluid which escapes through any unforeseen defects in the primary barrier.

32. An insulated container as claimed in claim 31 wherein the insulating material of the rear joint cover means comprises foamed resin.

33. An insulated container as claimed in claim 31 wherein the insulating material of the rear joint cover means comprises foamed resin and fibrous glass.

34. An insulated container as claimed in claim 31 wherein the insulating material of the rear joint cover means comprises polyurethane foam.

35. An insulated container as claimed in claim 31 wherein the outer facing material of the rear joint cover means comprises glass fiber reinforced resin.

36. An insulated container as claimed in claim 31 wherein the insulating material of the front joint cover means comprises foamed resin.

37. An insulated container as claimed in claim 31 wherein the insulating material of the front joint cover means comprises foamed resin and fibrous glass.

38. An insulated container as claimed in claim 31 wherein the insulating material of the front joint cover means comprises polyurethane foam.

39. An insulated container as claimed in claim 31 wherein the outer facing material of the front joint cover means comprises glass fiber reinforced resin.

40. An insulated container as claimed in claim 31 wherein the casings of the composite panels comprise glass fiber reinforced resin.

41. An insulated container as claimed in claim 31 wherein the insulating material in the rear compartments of the composite panels comprises foamed resin.

42. An insulated container as claimed in claim 31 wherein the insulating material in the rear compartments of the composite panels comprises polyurethane foam.

43. An insulated container as claimed in claim 31 wherein the insulating material in the rear compartments of some of the composite panels comprises foamed resin reinforced with cellular structure.

44. An insulated container as claimed in claim 31 wherein the insulating material in the rear compartments of some of the composite panels comprises foamed resin reinforced with honeycomb-shaped structure.

45. An insulated container as claimed in claim 31 wherein the insulating material in the front compartments of the composite panels comprises foamed resin.

46. An insulated container as claimed in claim 31 wherein the insulating material in the front compartments of the composite panels comprises polyurethane foam.

47. An insulated container as claimed in claim 31 wherein the insulating material in the front compartments of some of the composite panels comprises foamed resin reinforced with cellular structure.

48. An insulated container as claimed in claim 31 wherein the insulating material in the front compartments of some of the composite panels comprises foamed resin reinforced with honeycomb-shaped structure.

49. A insulated container as claimed in claim 31 wherein the studs are threaded and the fastening means comprises fastening strips secured on the studs by nuts.

50. An insulated container as claimed in claim 31 including elastomeric sealing strips mounted on the studs.

51. An insulated cryogenic liquid container as claimed in claim 31 wherein the casing of each composite insulating panel includes a rear backing plate having a plurality of projecting portions engaging the inner surface and providing clearance between the inner surface and the remainder of the backing plate for moisture drainage.

52. An insulated cryogenic liquid container comprising a supporting enclosure having a generally planar inner surface, a plurality of studs secured to the planar inner surface in regularly spaced parallel rows extending in each of two cross directions and defining a plurality of generally rectangular mounting areas on the planar inner surface, a plurality of generally rectangular composite insulating panels mounted on the planar inner surface respectively within the mounting areas, each composite panel including a generally rectangular backing plate, a generally rectangular rear core of insulating material disposed adjacent the backing plate, a generally rectangular interior panel disposed adjacent the rear core, a generally rectangular front core of insulating material disposed adjacent the interior panel, the front core being smaller than the rear core and disposed in stepped relationship thereto on four sides thereof, and a generally rectangular front casing having four sides stepped to match the cores and having outwardly extending rear flanges on the sides respectively secured to edge portions of the backing plate, the interior panel being secured to offsetting portions of the stepped sides of the front casing, mechanical fastening means operatively associated with the studs and with the rear flanges of the front casings of the composite panels and securing the composite panels in mounted position on the planar inner surface with space between the front casings of each pair of adjacent composite panels, rear joint cover means including insulating material disposed in the space between the front casings of each pair of adjacent composite panels rearwardly of the offsetting portions of the stepped sides and outer facing material covering the insulating material, bridging the space between the front casings, and being sealed to the offsetting portions of the stepped sides to form a secondary barrier for cryogenic liquids with the interior panels of the composite panels, and front joint cover means including insulating material disposed in the space between the front casings of each pair of adjacent composite panels forwardly of the outer facing material of the rear joint cover means, the front joint cover means also including outer facing material covering the insulating material thereof, bridging the space between the front casings, and being sealed to front panel portions thereof to form a primary barrier for cryogenic liquids therewith.

53. An insulated container as claimed in claim 52 wherein the insulating material of the rear joint cover means comprises foamed resin.

54. An insulated container as claimed in claim 52 wherein the insulating material of the rear joint cover means comprises foamed resin and fibrous glass.

55. An insulated container as claimed in claim 52 wherein the insulating material of the rear joint cover means comprises polyurethane foam.

56. An insulated container as claimed in claim 52 wherein the outer facing material of the rear joint cover means comprises glass fiber reinforced resin.

57. An insulated container as claimed in claim 52 wherein the insulating material of the front joint cover means comprises foamed resin.

58. An insulated container as claimed in claim 52 wherein the insulating material of the front joint cover means comprises foamed resin and fibrous glass.

59. An insulated container as claimed in claim 52 wherein the insulating material of the front joint cover means comprises polyurethane foam.

60. An insulated container as claimed in claim 52 wherein the outer facing material of the front joint cover means comprises glass fiber reinforced resin.

61. An insulated container as claimed in claim 52 wherein the front casings of the composite panels comprise glass fiber reinforced resin.

62. An insulated container as claimed in claim 52 wherein the backing plates of the composite panels comprise glass fiber reinforced resin.

63. An insulated container as claimed in claim 52 wherein the insulating material of the rear cores comprises foamed resin.

64. An insulated container as claimed in claim 52 wherein the insulating material of the rear cores comprises polyurethane foam.

65. An insulated container as claimed in claim 52 wherein the insulating material of the rear cores comprises foamed resin reinforced with cellular structure.

66. An insulated container as claimed in claim 52 wherein the insulating material of the rear cores comprises foamed resin reinforced with honeycomb-shaped structure.

67. An insulated container as claimed in claim 52 wherein the insulating material of the front cores comprises foamed resin.

68. An insulated container as claimed in claim 52 wherein the insulating material of the front cores comprises polyurethane foam.

69. An insulated container as claimed in claim 52 wherein the insulating material of the front cores comprises foamed resin reinforced with cellular structure.

70. An insulated container as claimed in claim 52 wherein the insulating material of the front cores comprises foamed resin reinforced with honeycomb-shaped structure.

71. An insulated container as claimed in claim 52 wherein the studs are threaded and the fastening means comprises fastening strips secured on the studs by nuts.

72. An insulated container as claimed in claim 52 including elastomeric sealing strips mounted on the studs.

73. An insulated cryogenic liquid container as claimed in claim 52 wherein the backing plate of each composite insulating panel includes a plurality of projecting portions engaging the planar inner surface and providing clearance between the planar inner surface and the remainder of the backing plate for moisture drainage.

74. A method of constructing an insulated cryogenic liquid container comprising providing a unitary composite insulating panel and a supporting enclosure having an inner surface, the unitary composite insulating panel including a casing having a front panel portion, an interior panel sealed to and dividing the casing into front and rear compartments, and insulating material in each of the compartments, and mounting the composite insulating panel as a unit on said inner surface of the supporting enclosure to thereby form a portion of a primary barrier and a portion of a secondary barrier in a single mounting operation, the front panel portion of the casing forming the portion of the primary barrier and the interior panel forming the portion of the secondary barrier, the portion of the primary barrier directly contacting and confining cryogenic liquid when the container is in use and the portion of the secondary barrier confining any cryogenic fluid which escapes through any unforeseen defects in the portion of the primary barrier.

75. An insulated cryogenic liquid container comprising a supporting enclosure having an inner surface, a composite insulating panel mounted on the inner surface, the composite insulating panel including a casing and insulating material in the casing, the casing having a front panel portion, a rear backing plate, and a rear mounting flange, and means clamping the mounting flange to the inner surface to secure the composite insulating panel in position, the front panel portion forming a portion of a primary barrier directly contacting and confining a cryogenic liquid when the container is in use, and the rear backing plate having a plurality of portions projecting from the remainder thereof rearwardly into engagement with the inner surface and providing clearance between the inner surface and the remainder of the backing plate, the projecting portions being spaced from each other at intervals across the rear backing plate in a manner accommodating moisture drainage.

76. An insulated cryogenic liquid container as claimed in claim 75 wherein the composite insulating panel includes an interior panel sealed to and dividing the casing into front and rear compartments each having insulating material therein, the interior panel forming a portion of a secondary barrier for confining any cryogenic fluid which escapes through any unforeseen defect in the primary barrier.

77. An insulated cryogenic liquid container comprising a supporting enclosure having an inner surface, a pluraltiy of composite insulating panels each including a casing, an interior panel sealed to and dividing the casing into front and rear compartments, and insulating material in each of the compartments, the composite panels being mounted in a covering layer over the inner surface with space between the casings of each pair of adjacent composite panels, and front joint cover means and rear joint cover means each including facing material bridging the space between and being sealed to the casings, the casings and the facing material of the front joint cover means forming a primary barrier directly contacting and confining cryogenic liquid when the container is in use, and the interior panels and the facing material of the rear joint cover means forming a secondary barrier confining any cryogenic fluid which escapes through any unforeseen defects in the primary barrier when the container is in use.

* * * * *